US005685177A

United States Patent [19]

Matsuda et al.

[11] Patent Number: 5,685,177

[45] Date of Patent: Nov. 11, 1997

[54] KNIT SLIDE FASTENER WITH REINFORCED EDGE SECTION FOR ATTACHMENT OF CHAIN

[75] Inventors: Yoshio Matsuda; Hidenobu Kato; Yoshito Ikeguchi, all of Toyama-ken, Japan

[73] Assignee: YKK Corporation, Tokyo, Japan

[21] Appl. No.: 649,077

[22] Filed: May 16, 1996

[30] Foreign Application Priority Data

May 18, 1995 [JP] Japan ..... 7-155097

[51] Int. Cl.[6] ..... A44B 19/56; D04B 23/05

[52] U.S. Cl. ..... 66/193; 66/195

[58] Field of Search ..... 66/193, 195

[56] References Cited

U.S. PATENT DOCUMENTS

| | | | |
|---|---|---|---|
| 3,474,644 | 10/1969 | Frank | 66/195 X |
| 3,864,945 | 2/1975 | Fröhlich | 66/193 |
| 4,265,003 | 5/1981 | Matsuda | 66/193 X |
| 4,378,683 | 4/1983 | Matsuda et al. | 66/193 |
| 4,502,302 | 3/1985 | Matsuda | 66/193 |
| 5,035,125 | 7/1991 | Fröhlich et al. | 66/193 |
| 5,502,985 | 4/1996 | Matsuda et al. | 66/193 |
| 5,502,986 | 4/1996 | Matsuda et al. | 66/193 |
| 5,540,064 | 7/1996 | Matsuda et al. | 66/193 |

FOREIGN PATENT DOCUMENTS

| | | | |
|---|---|---|---|
| 2 188 976 | 1/1974 | France . | |
| 2103774 | 8/1972 | Germany | 66/193 |
| 30 26 487 | 8/1984 | Germany . | |
| 38 011 673 | 7/1963 | Japan . | |

*Primary Examiner*—John J. Calvert

*Attorney, Agent, or Firm*—Hill, Steadman & Simpson

[57] ABSTRACT

In a knit slide fastener in which a continuous fastener element row is knitted in a fastener element attaching portion of each fastener tape simultaneously with the knitting of the fastener tape, a plurality of laid-in weft yarns are knitted in the warp-knit structure of the fastener element attaching portion so as to turn alternately in every course and to be interlaced with knit loops of a chain stitch extending along the outermost edge of the fastener element attaching portion, and the fastener element row is secured to the ground structure of the attaching portion by two binding chain stitches.

2 Claims, 13 Drawing Sheets

10
13
14
16
17
18

KNIT SLIDE FASTENER WITH REINFORCED EDGE SECTION FOR ATTACHMENT OF CHAIN

BACKGROUND OF THE INVENTION

1. Field of the Invention

This invention relates to a knit slide fastener in which a coiled fastener element row is continuously knitted in a fastener element attaching portion at a longitudinal edge portion of each of opposed warp-knit fastener tapes simultaneously with the knitting of the fastener tape, and more particularly to a knit slide fastener having a fastener element attaching structure that can prevent coupled fastener element rows from any accidental split due to a large bending force and thrusting force exerted on the slide fastener.

2. Description of the Related Art

In one type of conventional knit slide fastener, as disclosed in, for example, Japanese Patent Publication No. Sho 38-11673, each of opposed fastener tapes is knitted of chain stitches and laid-in weft yarns, and a fastener element row of a coiled nylon monofilament is knitted in the chain stitches of the fastener tape as being anchored by sinker loops of the chain stitches, simultaneously with the knitting of the fastener tape. In another type of conventional knit slide fastener, as disclosed in, for example, U.S. Pat. No. 5,035,125, each of opposed fastener tapes is knit of chain stitches and laid-in weft yarn, and a fastener element row of a plastic monofilament is knitted in a longitudinal edge portion of the tape simultaneously with the knitting of the fastener tape in such a manner that the laid-in weft yarns are interlaced with the wales of chain stitches extending over upper legs of fastener elements so as to press the upper legs toward the tape and also with the wale of chain stitches extending over lower legs of the fastener elements so as to press the lower legs against the tape.

With the first-named type knit slide fastener, since the fastener elements are held by sinker loops of chain stitches of the ground structure of the fastener tape, dimensional stability cannot be achieved due to the longitudinal expansion and shrinkage of the chain stitches. And since the row of fastener elements are not firmly attached into the ground structure, stable attaching position of the fastener element row cannot be retained. Hence smooth coupling of the fastener elements cannot be realized. With the second-named type knit slide fastener, in which the laid-in weft yarn extending from the longitudinal portion of the fastener tape is interlaced with the needle loops of the chain stitches, since the needle loop rows of the two binding chain stitches extending over the fastener element row are arranged merely in parallel in such a manner that individual needle loops of each binding chain stitch are successively knit longitudinally, the longitudinal edge portion of the fastener tape tends to expand and shrink so that firm attaching of the fastener element row cannot be achieved. Thus the needle loops of the parallel anchoring chain stitches tend to be displaced sideways, so it is impossible to attach the fastener element row in a stable posture so that smooth coupling of the fastener elements cannot be realized, thus causing the coupled fastener element rows to accidentally split during use.

SUMMARY OF THE INVENTION

It is therefore an object of this invention to provide a high-quality knit slide fastener in which, by reinforcing a ground structure of a fastener element attaching portion, a pair of fastener element rows is attached to opposed longitudinal edge portions of a pair of fastener tapes firmly with dimensional stableness, keeping a uniform attached posture of the individual fastener elements and hence making the coupled fastener element rows free from any accidental split.

In order to accomplish the above object, according to a first aspect of the invention, there is provided a knit slide fastener having a pair of fastener tapes each composed of a warp-knit ground structure having a fastener element attaching portion at a longitudinal edge portion thereof, and a pair of continuous fastener element rows each knitted in the fastener element attaching portion simultaneously with the knitting of the respective fastener tape. In the slide fastener, a chain stitch having a succession of knit loops extends along an outermost edge of each fastener element attaching portion. Every one of the knit loops is interlaced with one of a plurality of laid-in weft yarns laid in fastener element attaching portion to form the ground structure of the fastener element attaching portion. And a plurality of binding chain stitches are knitted in each fastener element attaching portion to bind the continuous fastener element row to the ground structure of each fastener element attaching portion.

According to a second aspect of the invention, there is provided a knit slide fastener having a pair of fastener tapes each composed of a warp-knit ground structure having a fastener element attaching portion at a longitudinal edge portion thereof, and a pair of continuous fastener element rows each knitted in the fastener element attaching portion simultaneously with the knitting of the respective fastener tape. In the slide fastener, a chain stitch having a succession of knit loops extends along an outermost edge of each fastener element attaching portion. Every one of the knit loops is interlaced with one of a plurality of laid-in weft yarns laid in fastener element attaching portion to form the ground structure of the fastener element attaching portion. And a plurality of binding chain stitches are knitted in a double knit structure in each fastener element attaching portion to bind the continuous fastener element row to the ground structure of each fastener element attaching portion.

DETAILED DESCRIPTION OF THE PREFERRED EMBODIMENTS

Various preferred embodiments of this invention will now be described with reference to the accompanying drawings.

Figure 1:
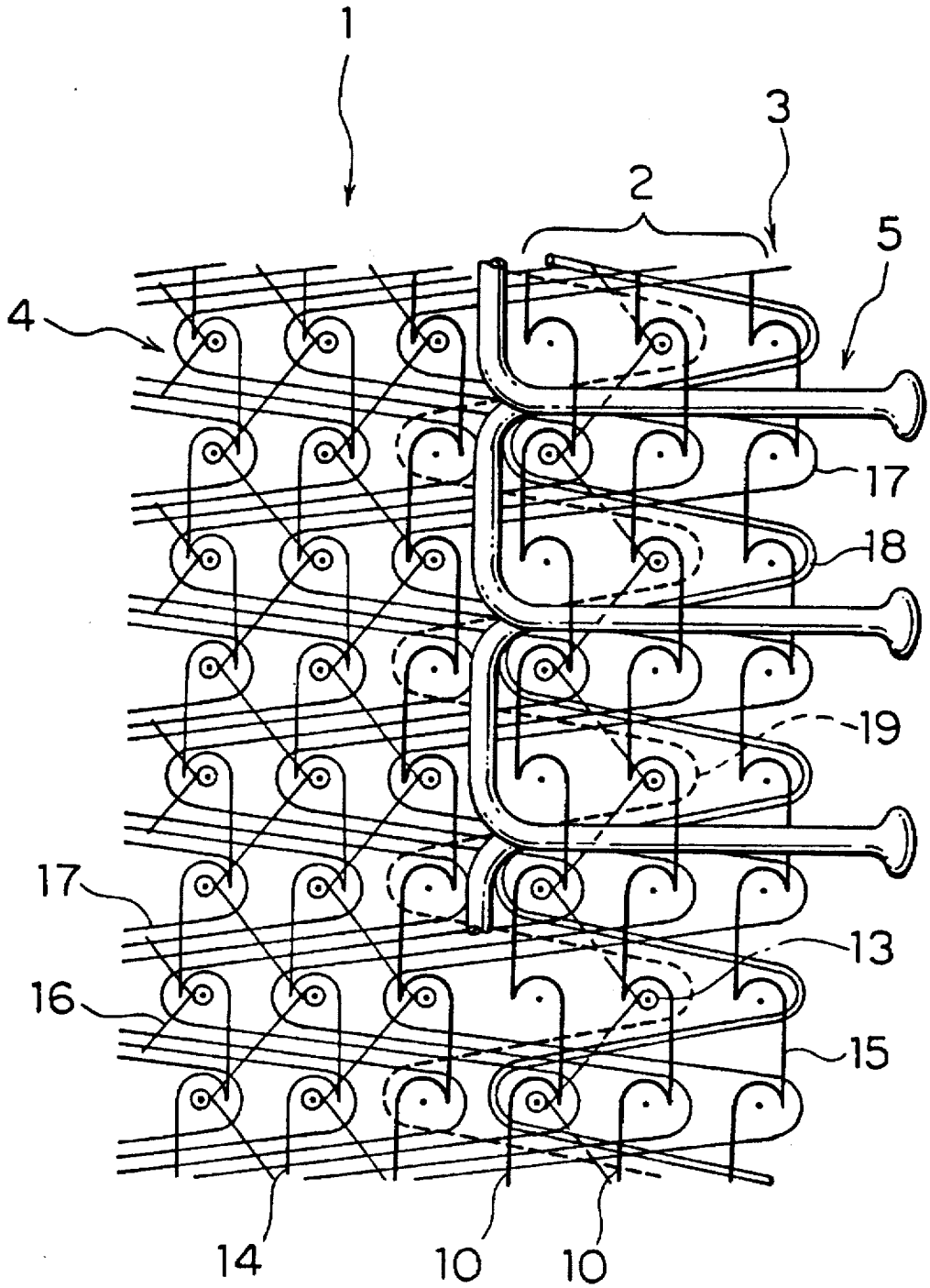
FIG. 1 is a fragmentary diagram showing a knit slide fastener, which is knitted using a single needle bed, according to a first embodiment of this invention.
Figures 2A, 2B, 2C, 2D, 2E, 2F:
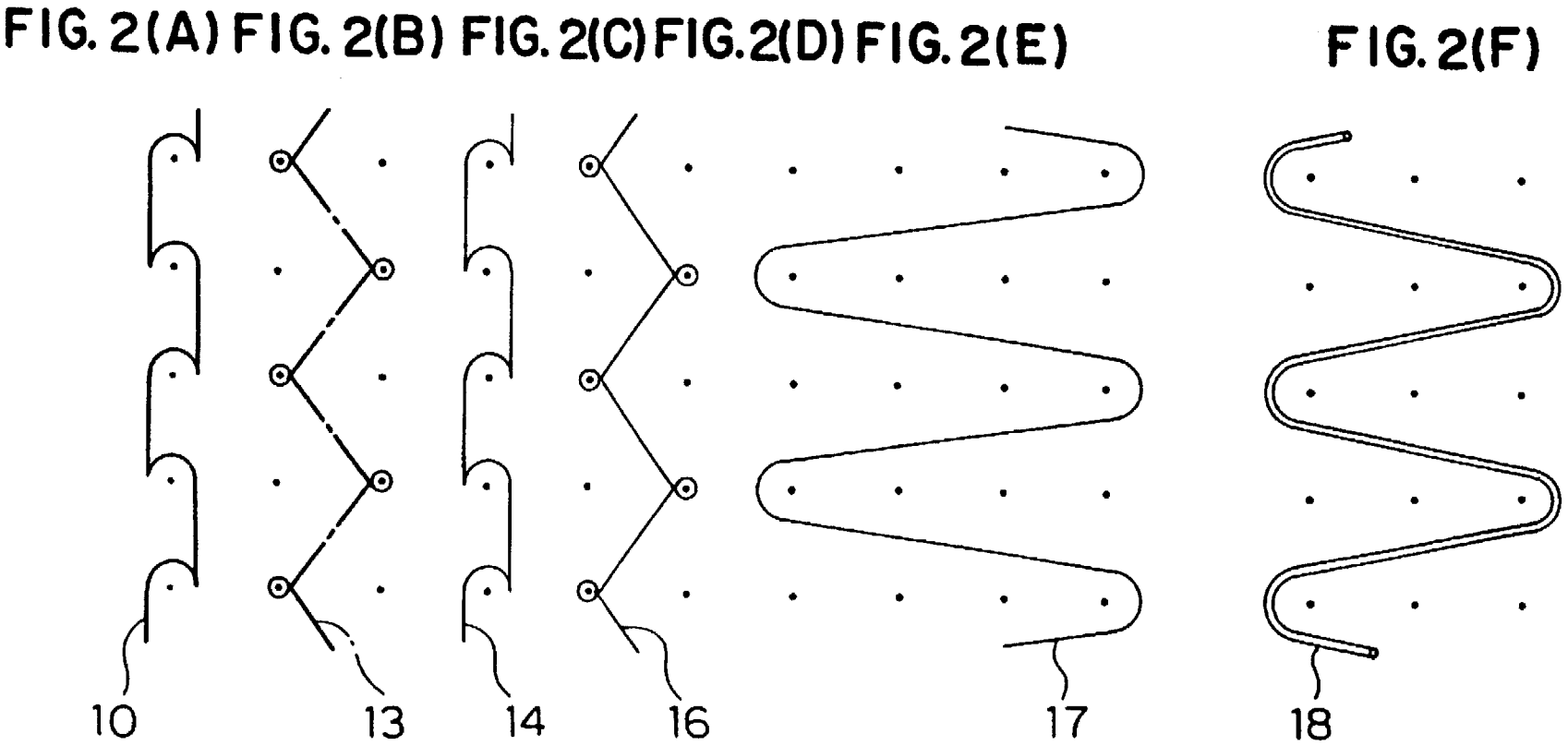
FIGS. 2(A) through 2(F) are point diagrams showing knitting patterns of individual knitting yarns used in the knit slide fastener of FIG. 1.
Figure 3:
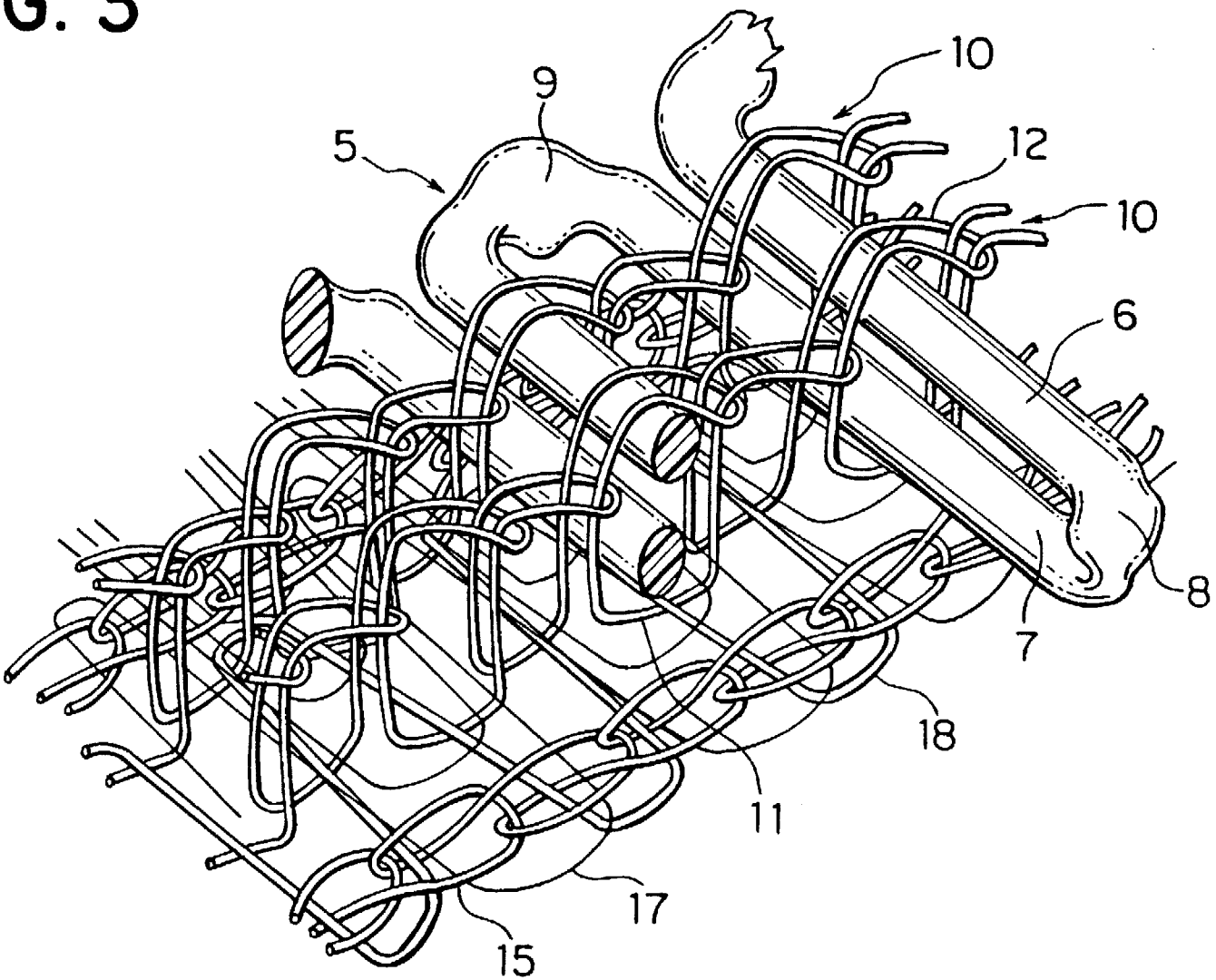
FIG. 3 is a fragmentary perspective view schematically showing the manner in which a fastener element row is attached to the corresponding fastener tape of the knit slide fastener of FIG. 1.
Figure 4:
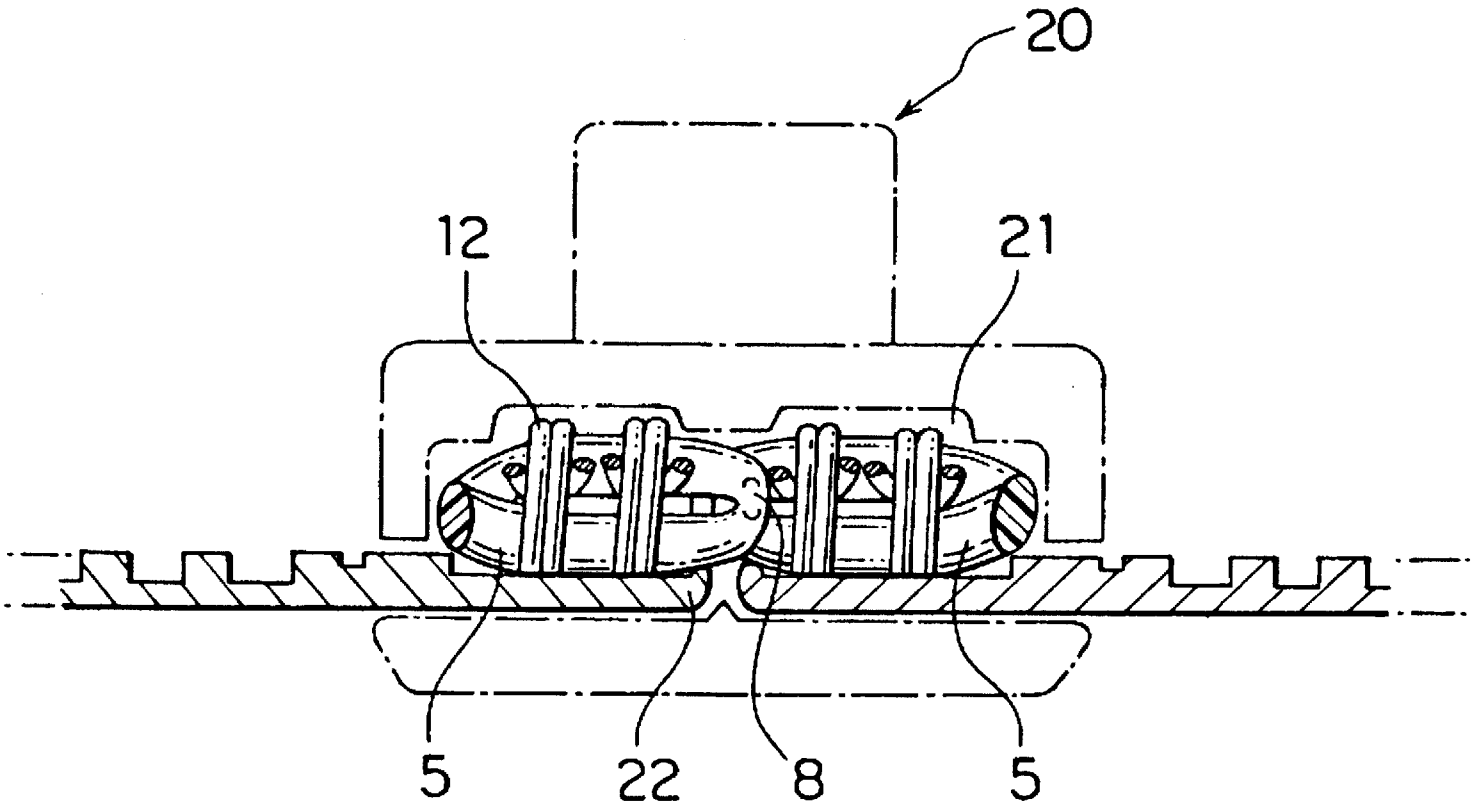
FIG. 4 is a fragmentary transverse cross-sectional view showing the manner in which opposed fastener element rows of the knit slide fastener of FIG. 1 are coupled together by a slider.

FIG. 1 is a fragmentary diagram showing a knit slide fastener according to a first embodiment of this invention. FIGS. 2(A) through 2(F) are point diagrams showing knitting patterns of individual knitting yarns used in the knit slide fastener of the first embodiment. FIG. 3 is a fragmentary perspective view schematically showing a longitudinal edge portion of each of opposed fastener tapes to which portion a fastener element row is attached. FIG. 4 is a fragmentary transverse cross-sectional view showing opposed fastener element rows coupled together by a slider.

In this embodiment and the following second and third embodiments, the knit slide fastener (hereinafter called the slide fastener) is knitted on a common warp-knitting machine having a single needle bed. The slide fastener of the first embodiment has a fastener element attaching portion 2 along one longitudinal edge of each of opposed fastener tapes 1. The fastener tape 1 except the fastener element attaching portion 2 has a ground structure knitted of a number of chain stitches 14 having a knitting pattern of 1-0/0-1 (FIG. 2(C)), a number of tricot stitches 16 having a-knitting pattern of 1-2/1-0 (FIG. 2(D)), and a number of laid-in weft yarns 17 extending weftwise across four wales 3 in a zigzag pattern of 0-0/4-4 (FIG. 2(E)). Alternatively, the laid-in weft yarn 17 may extend weftwise across three wales in a zigzag pattern, or may run weftwise across all wales 3 of the fastener tape 1 changing courses 4 and extending longitudinally of the fastener tape 1 in a zigzag pattern. The ground structure of The fastener tapes of the second and third embodiments are identical with the first embodiment in this respect.

The fastener element attaching portion 2 of the longitudinal edge portion of the fastener tape 1 is composed of a ground structure on which a fastener element row 5 is to be supported, and a number of knitting yarns by which the fastener element row 5 is to be secured to the ground structure. The ground structure on which the fastener element row 5 is to be supported includes along the outer-most edge one wale of chain stitch 15 having a knitting pattern of 1-0/0-1 and being composed of a yarn same as those of the chain stitches 14 of the ground structure of the fastener tape 1, and a laid-in weft yarn 17 (0-0/4-4) turning at every other course ends and interlaced with the chain stitches of the outermost wale. As a result, the laid-in weft yarn 17 interlaces with chain stitches at every other courses so that the ground structure of the fastener element attaching portion 2 would have alternately coarse and dense parts and would hence become wavy or puckered. In order to make the ground structure free from becoming wavy, in this invention, a reinforcing laid-in weft yarn 18 is laid in the ground structure so as to turn at and to be interlaced with every other chain stitches which is not interlaced with the laid-in weft yarn 17, running across three wales in a zigzag pattern to supplement the courses devoid of the laid-in weft yarn 17. The ground structure of the fastener element attaching portion 2 becomes uniformly dense and hence the fastener element row 5 is held firmly with dimensional stability. Alternatively, another reinforcing laid-in weft yarn 19 may be added to turn at and to be interlaced with chain stitches of one of binding chain stitches 10 for holding the fastener element row 5, which forms one wale next to the outermost, as indicated in dotted lines in FIG. 1.

The fastener element row 5 is in the form of a continuous coiled monofilement knitted by the two binding chain stitches 10, 10 knitted in a pattern of 1-0/0-1, running in reciprocation in the same course weftwise in every other courses 4. The coiled fastener element row 5 is attached to the fastener element attaching portion 2 simultaneously with the knitting of the fastener tape 1, with upper legs 6 pressed by the two binding chain stitches 10, 10 knitted in two wales 3. Also a binding tricot stitch 13 may be knitted in the fastener element attaching portion 2, running between the wales of the two binding chain stitches 10 in a pattern of 1-2/1-0 as indicated by dash-and-dot lines in FIG. 1, so that the binding chain stitches 10 can be prevented from being displaced sideways, thus making the coupled fastener element rows 5 free from any accidental split while the slide fastener is in use.

In FIG. 3, for a better understanding, the laid-in weft yarns 17 are shown merely in a single line, and stitches are drawn to be thin, and needle loops are shown as slackened. Practically, the size of each knitting yarn is selected as desired, considering the required function of the knit slide fastener, and the stitches are dense. The same thing can be said for FIGS. 9 and 12. The coiled fastener element row 5, which is continuously formed of a monofilament of synthetic resin such as nylon or polyester and is previously flattened at portions corresponding to coupling heads 8 and connecting portions 9 by stamping, runs in reciprocation in the same course weftwise in every other courses 4, with upper and lower legs 6, 7 overlapping each other as the monofilement is bent at the flattened portions of the coupling head 8 and the connecting portion 9. The fastener element row 5 is held by the binding chain stitches 10. Specifically, sinker loops 11, which are located on the lower side of the fastener element row 5, of the binding chain stitches 10 are merely interlaced with the two laid-in weft yarns 17, 18 of the ground structure of the fastener element attaching portion 2 without forming any knit loop to consist the ground structure of the fastener element attaching portion 2 on which the coiled fastener element row 5 is supported. And needle loops 12, which are located on the upper side of the fastener element row 5, of the binding chain stitches 10 form two longitudinal successions of stitch loops, as shown in FIGS. 1 and 3. In every two courses, preceding needle loops 12 are located over the respective upper legs of the fastener element row 5, and succeeding needle loops 12 are located in the respective inter-element spaces, each preceding needle loop 12 extending in a generally reversed U shape from the upper leg 6 to the lower leg 7 so as to press the fastener element row 5 against the ground structure.

FIG. 4 is a fragmentary transverse cross-sectional view showing fastener element row 5 attached to the fastener element attaching portion 2. The upper legs 6 of fastener elements of the fastener element row 5 are pressed by the needle loops 12 of the binding chain stitches 10, thus securing the fastener element row 5 to the fastener element attaching portion 2. The outermost edge 22 of the longitudinal edge portion of the fastener tape 1 is prevented from becoming wavy due to the non-uniform knit structure, by the two laid-in weft yarns 17, 18 alternately interlaced with the knit loops of the chain stitch 15. With this wave-free edge 22 of the fastener element attaching portion 2, it is possible to move a slider 20 smoothly without any knitting yarn of the outermost edge 22 of the fastener element attaching portion 2 locally contacting a guide channel 21 of the slider 20.

Figure 5:
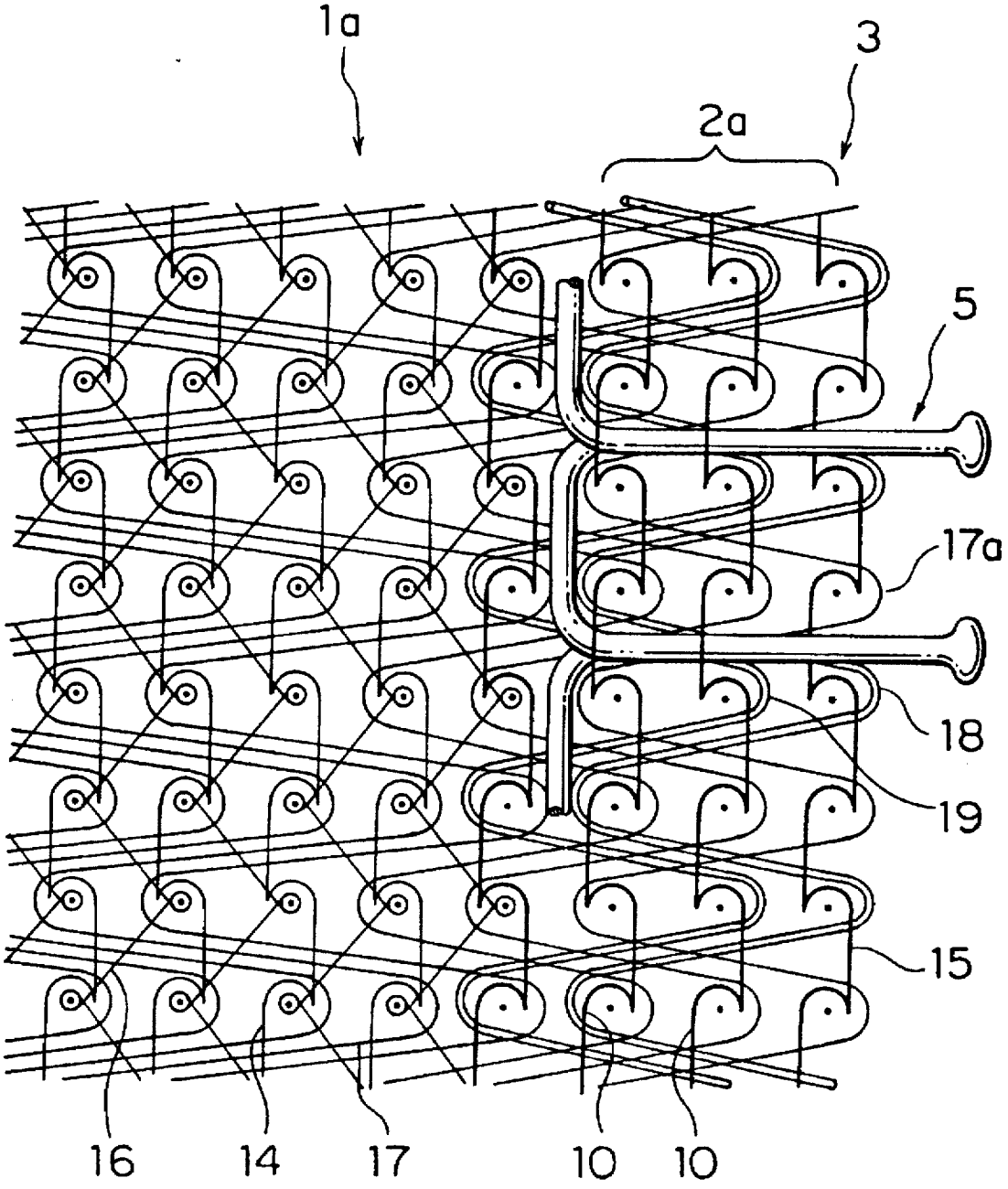
FIG. 5 is a diagram showing a modified knit slide fastener using two kinds of laid-in weft yarns according to a second embodiment.
Figure 6C:
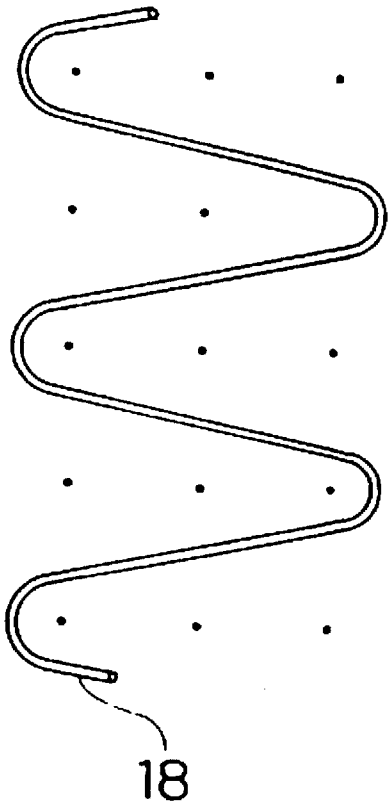
FIGS. 6(A), 6(B) and 6(C) are point diagrams showing knitting patterns of individual laid-in weft yarns used in the knit slide fastener of FIG. 5.
Figure 6B:
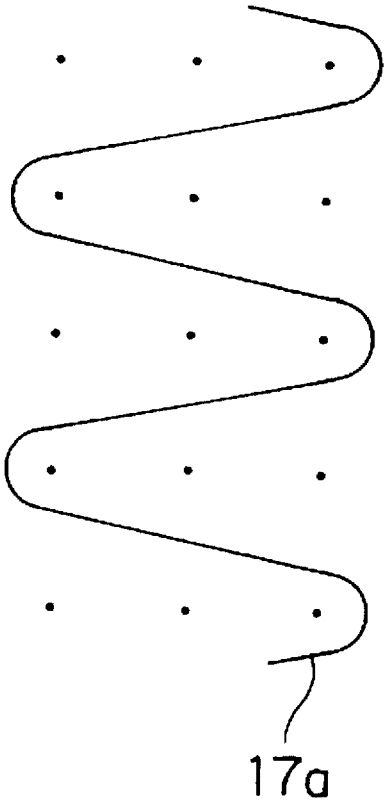
Figure 6A:
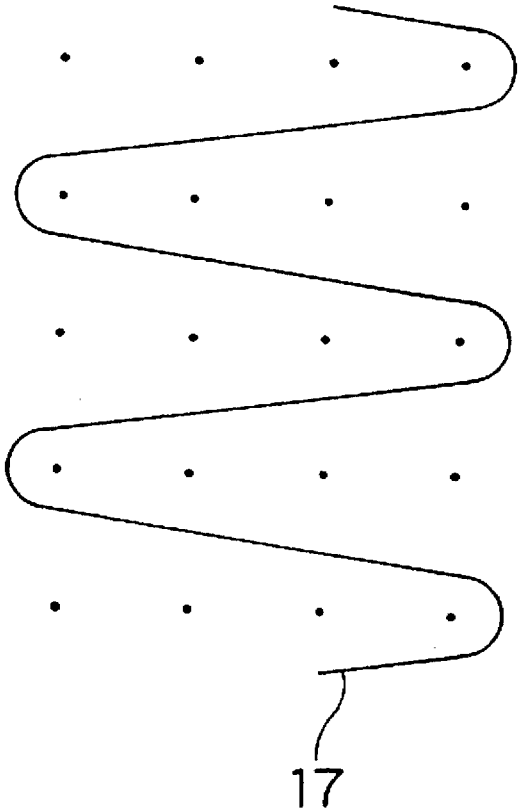

FIG. 5 is a fragmentary diagram showing a knit slide fastener according to a second embodiment, and FIGS. 6(A), 6(B) and 6(C) are point diagrams showing knitting patterns of individual laid-in weft yarns.

The second embodiment is identical in knit structure with the first embodiment except that the laid-in weft yarns of the ground structure of the fastener element attaching portion 2 are modified. Although the ground structure of the fastener tape la of this embodiment, like the first embodiment, is knitted of a number of chain stitches 14, a number of tricot stitches 16, and a number of laid-in weft yarns 17 extending across four wales in a pattern of 0-0/4-4, the laid-in weft yarns 17 in the fastener element attaching portion 2*a* are substituted by modified laid-in weft yarns 17*a* extending across three wales in a pattern of 0-0/3-3, as shown in FIG. 5, similarly to reinforcing laid-in weft yarns 18, 19 extending across three wales in a pattern of 3-3/0-0 in the fastener element attaching portion 2*a*, thus balancing in shrinkage of yarns due to heat treatment when finishing the slide fastener. All the laid-in weft yarns 17 of the ground structure of the fastener tape la may extend across three wales throughout the entire width of the fastener tape la including the fastener element attaching portion 2*a*. The number of wales across which the laid-in weft yarns 17, 18, 19 extend may be selected by considering, for example, the size of the fastener element row 5 to be attached to the fastener element attaching portion and the degree of softness of the fastener tape 1.

Figure 7:
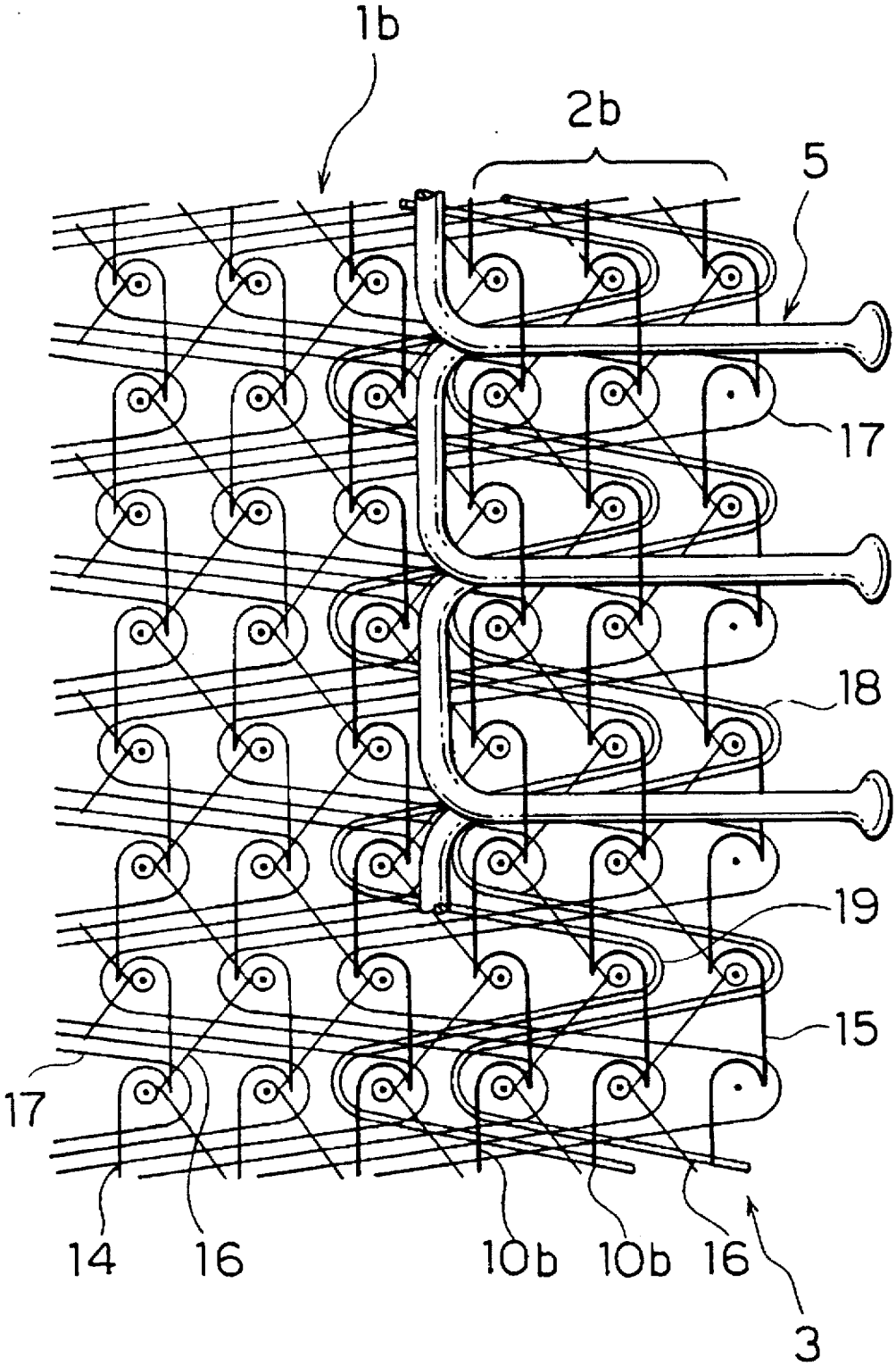
FIG. 7 is a diagram showing another modified knit slide fastener, in which each fastener element row is held by sinker loops of chain stitches, according to a third embodiment.
Figures 8A, 8B, 8C, 8D:
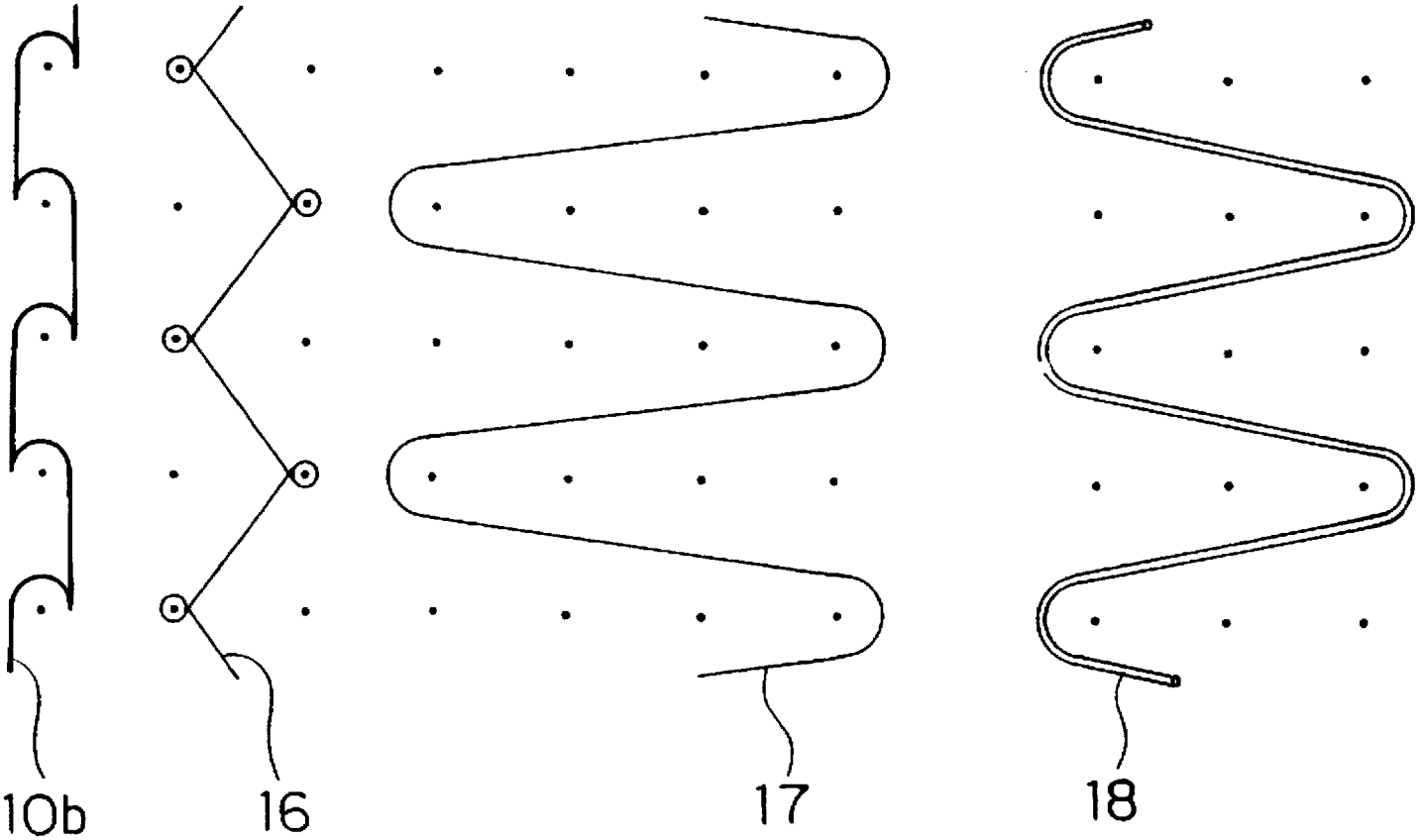
FIGS. 8(A) through 8(D) are point diagrams showing knitting patterns of individual knitting yarns used in the knit slide fastener of FIG. 7.
Figure 9:
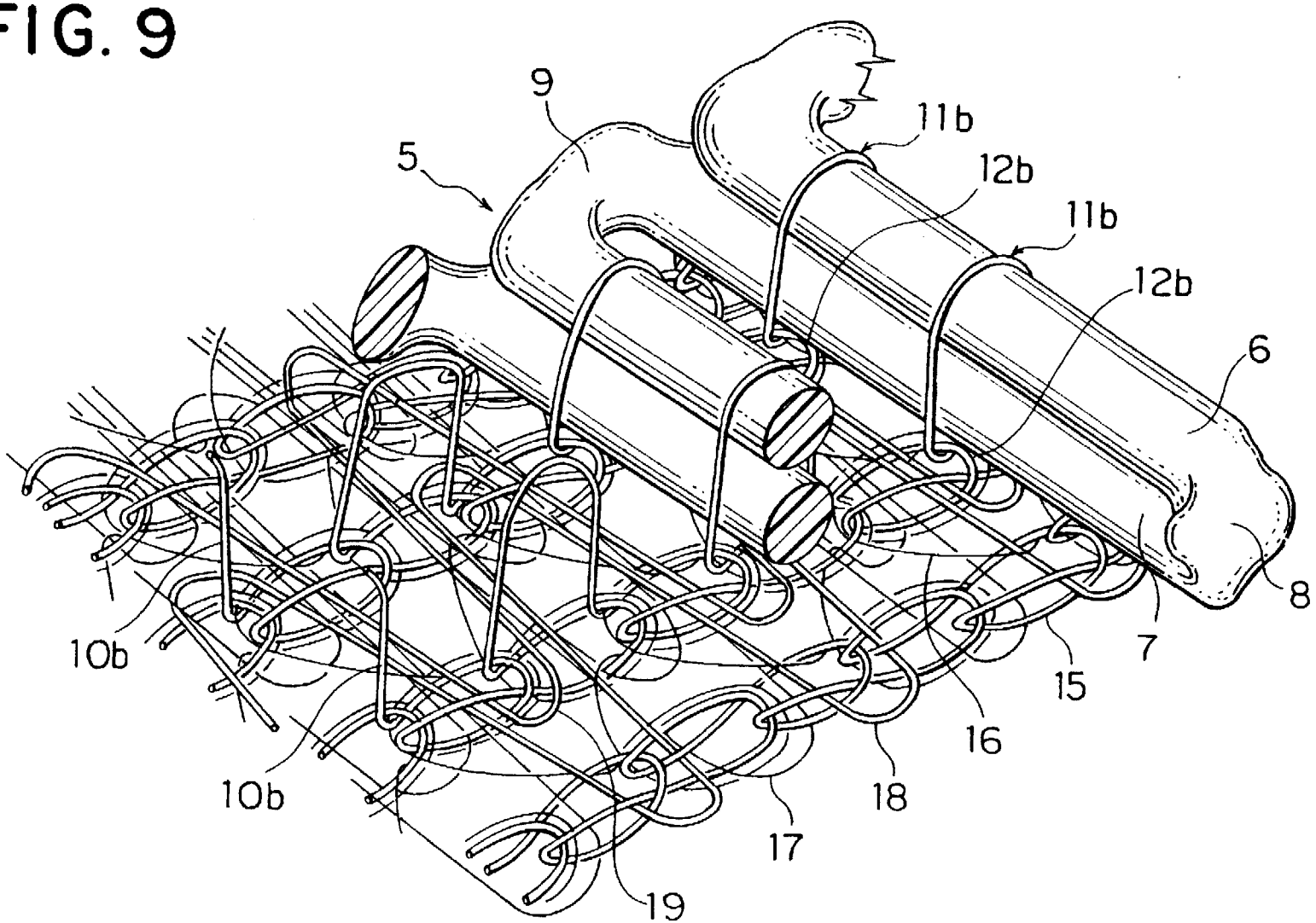
FIG. 9 is a fragmentary perspective view schematically showing the manner in which a fastener element row is attached to the corresponding fastener tape of the knit slide fastener of FIG. 7.

FIG. 7 is a fragmentary diagram showing a knit slide fastener according to a third embodiment. FIGS. 8(A) through 8(D) are point diagrams showing knitting patterns of individual knitting yarns used in the slide fastener of the third embodiment. FIG. 9 is a fragmentary perspective view schematically showing a longitudinal edge portion of the fastener tape on which a fastener element row is attached.

In the first embodiment, the upper leg 6 of the fastener element row 5 is pressed by needle loops 12 of the binding chain stitches 10. Whereas in the third embodiment, the upper leg 6 of the fastener element row 5 is pressed by sinker loops 11*b* of the binding chain stitches 10*b*.

The-fastener tape 1*b* of the third embodiment, like the first embodiment, is knitted of a number of chain stitches 14, a number of tricot stitches 16, and a number of laid-in weft yarns 17 extending across four wales in a zigzag pattern. The fastener element attaching portion 2*b* along the longitudinal edge of the fastener tape 1*b* includes a ground structure on which the fastener element row 5 is to be supported, and a number of knitting yarns for binding the fastener element row 5 to the ground structure. The ground structure on which the fastener element row 5 is supported is knitted of a number of tricot stitches 16 same as those in the fastener tape 1*b*, a number of laid-in weft yarns 17 same as those in the fastener tape 1*b* and extending across four wales, a first reinforcing laid-in weft yarn 18 extending across three wales in zigzag pattern so as to turn at every other course ends and to be interlaced with chain stitches of the outermost wale alternately with respect to the laid-in weft yarns 17, and a second reinforcing laid-in weft yarn 19 located inwardly of the first reinforcing laid-in weft yarn 18 by one wale.

The fastener element row 5 is held by two binding chain stitches 10*b*, 10*b* knitted in the fastener element attaching portion 2*b* simultaneously with the knitting of the fastener tape 1*b* and running in reciprocation in the same course weftwise in every other courses in a pattern of 1-0/0-1. FIG. 9 schematically shows the manner in which the fastener element row 5 is attached to the fastener element attaching portion 2*b*. Needle loops 12*b*, 12*b* of the two binding chain stitches 10*b*, 10*b* are located on the lower side of the fastener element row 5 as shown in FIG. 9, to form the ground structure of the fastener element attaching portion 2*b* on which the coiled fastener element row is supported, together with the three laid-in weft yarns 17, 8, 19 and the tricot stitch 16. And sinker loops 11*b*, 11*b* of the two binding chain stitches 10*b*, 10*b* are located on the upper side of the fastener element row 5, thus pressing the fastener element row 5, with upper and lower legs 6, 7 overlapping each other, against the ground structure.

Figure 10:
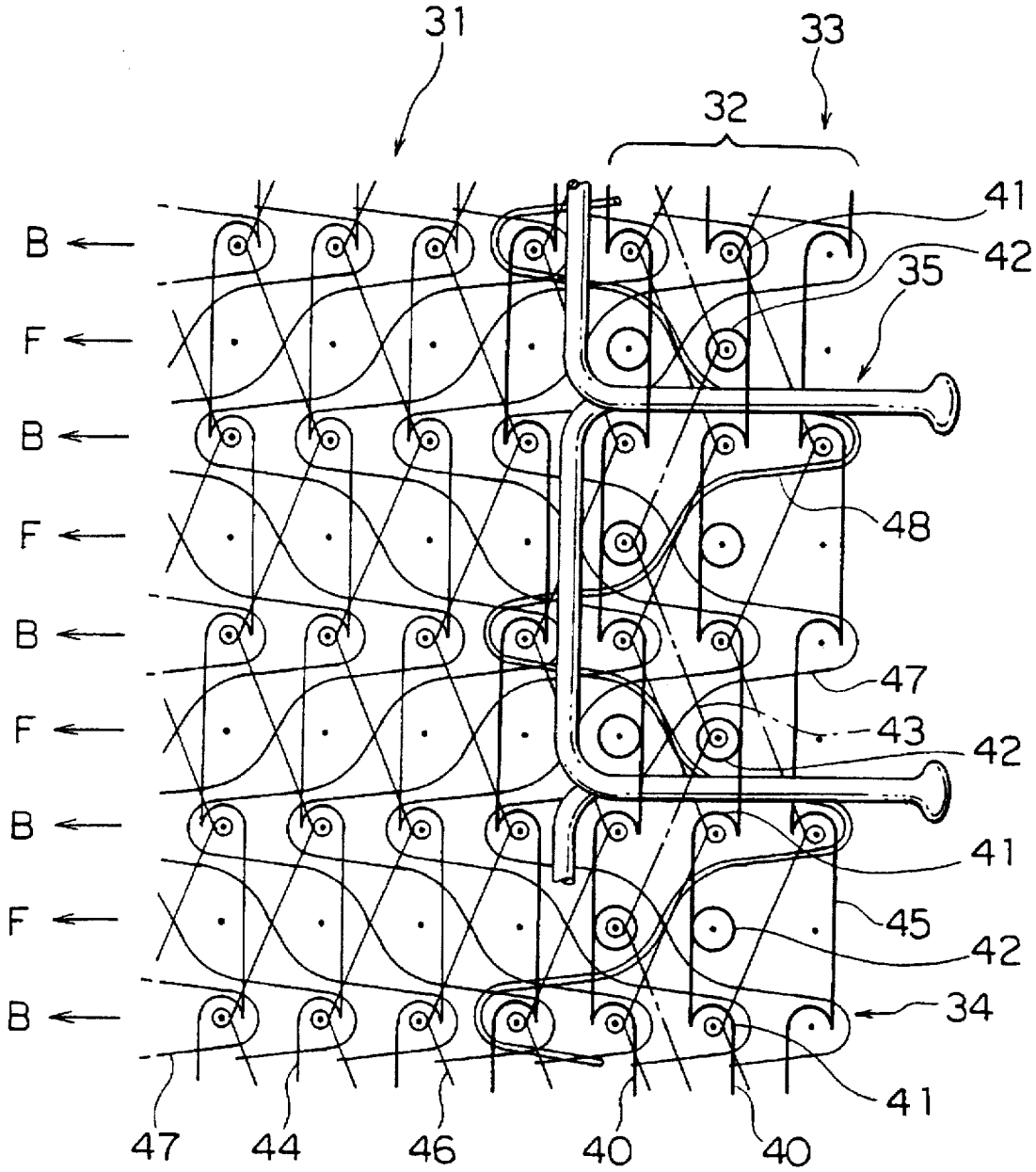
FIG. 10 is a diagram showing a knit slide fastener, which is knitted using double needle bed, according to a fourth embodiment of this invention.
Figures 11A, 11B, 11C, 11D, 11E, 11F:
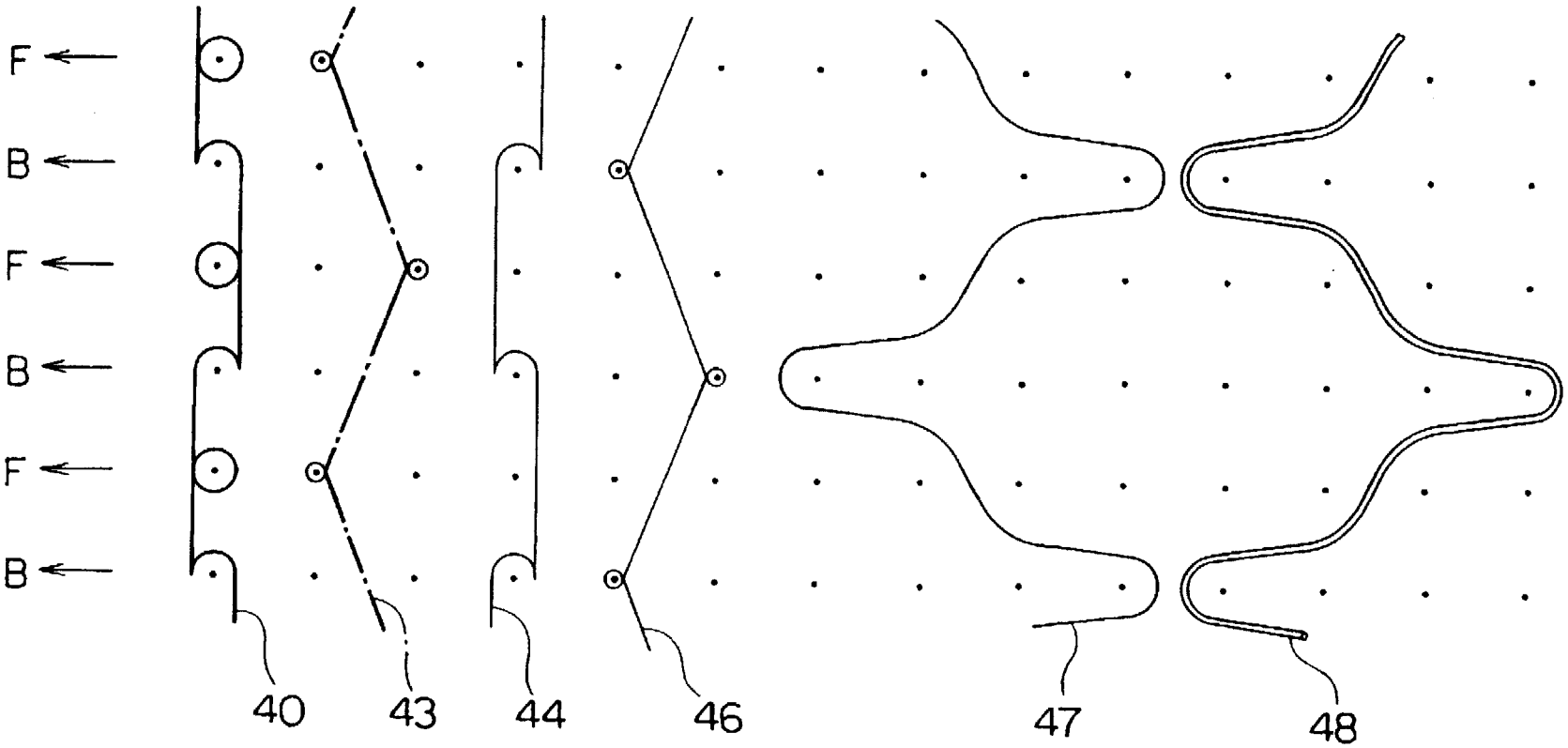
FIGS. 11(A) through 11(F) are point diagrams showing knitting patterns of individual knitting yarns used in the knit slide fastener of FIG. 10.
Figure 12:
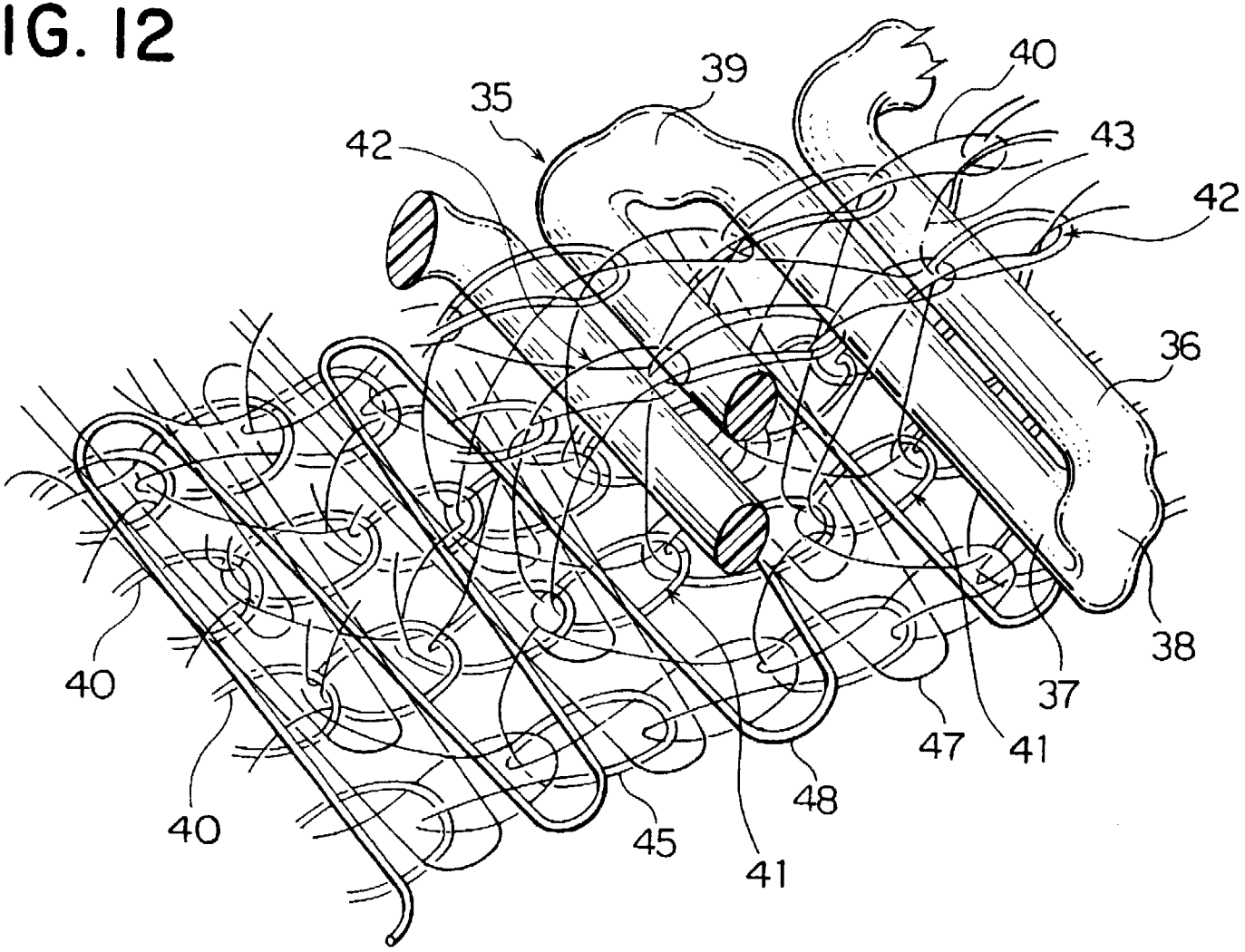
FIG. 12 is a fragmentary perspective view schematically showing the manner in which a fastener element row is attached to the corresponding fastener tape of the knit slide fastener of FIG. 10.
Figure 13:
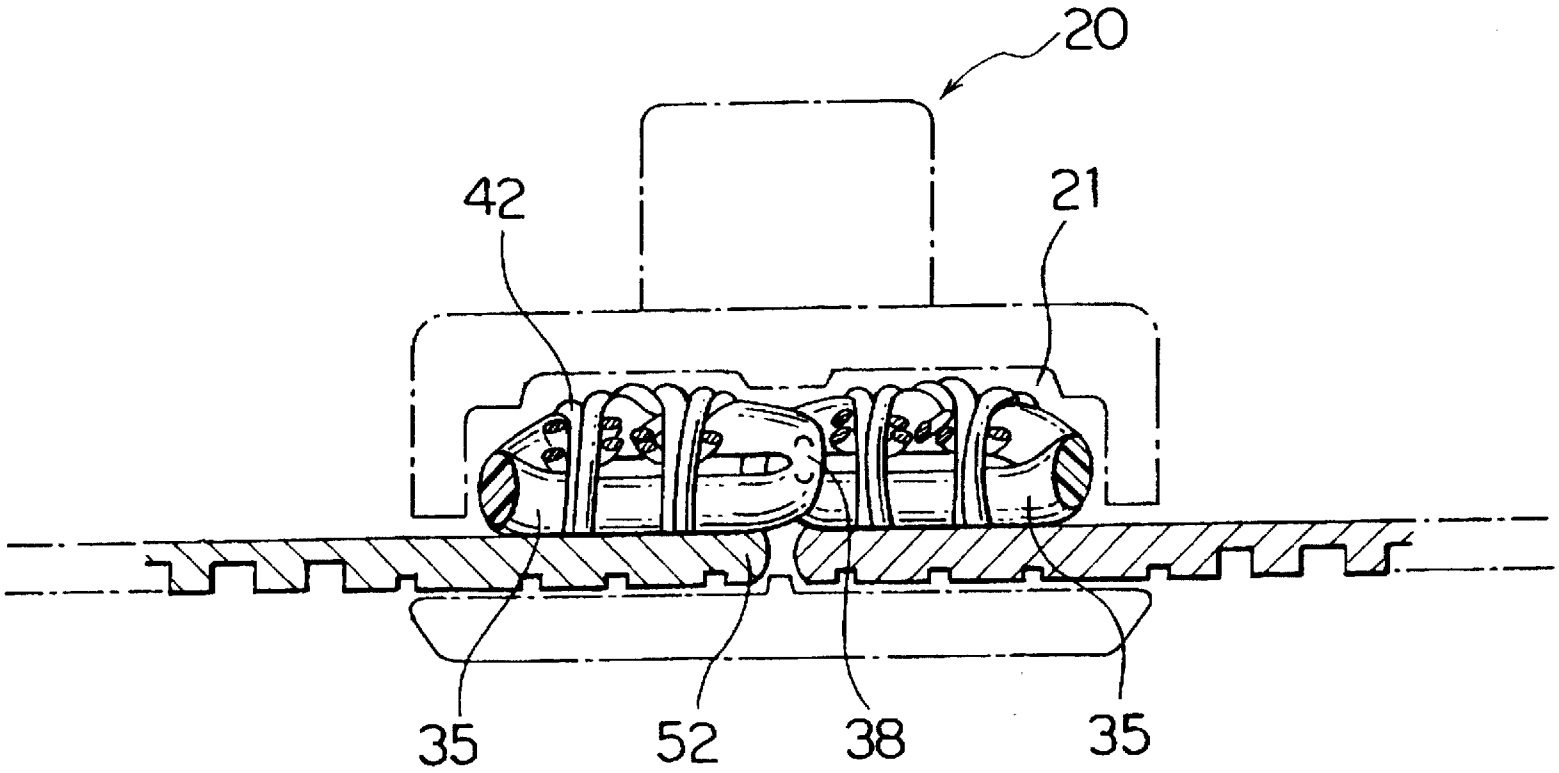
FIG. 13 is a fragmentary transverse cross-sectional view showing the posture in which opposed fastener element rows of the knit slide fastener of FIG. 10 are coupled together by a slider.

FIG. 10 is a fragmentary diagram showing a knit slide fastener according to a fourth embodiment. FIGS. 11(A) through 11(F) are point diagrams schematically showing knitting patterns of individual knitting yarns used in the knit slide fastener of the fourth embodiment. FIG. 12 schematically shows the longitudinal edge portion of the fastener tape on which the fastener element row is supported. FIG. 13 is a fragmentary transverse cross-sectional view showing the posture in which opposed fastener element rows are coupled together by a slider.

The slide fastener of the fourth embodiment is knitted on a warp-knitting machine, such as a double-raschel knitting machine, having double needle bed. Each of opposed fastener tapes 31 of the slide fastener has a ground structure knitted of a number of chain stitches 44 having a knitting pattern of 1-0/0-0/0-1/1-1 (FIG. 11(C)), a number of tricot stitches 46 having a knitting pattern of 1-2/1-1/1-0/1-1 (FIG. 11(D)), and a number of laid-in weft yarns 47 each extending across four wales 33 of the fastener tape 31 in a zigzag pattern of 0-0/2-2/4-4/2-2 (FIG. 11(E)). Alternatively, the laid-in weft yarn 47 may run weftwise across all wales 33 of the fastener tape 31 changing courses 34, and extending longitudinally in a zigzag pattern.

In a fastener element attaching portion 32 extending along one longitudinal edge of the fastener tape 31, a monofilament of synthetic resin is laid in and runs in reciprocation in the same course weftwise in courses, with upper and lower legs 36, 37 overlapping each other as the monofilament is bent at previously flattened portions for coupling heads 38 and connecting portions 39 into a continuous coiled fastener element row 35. The upper leg 36 is pressed by the two binding chain stitches 40 knitted in the fastener element attaching portion 32 in a pattern of 0-1/1-0/1-0/0-1, attaching the coiled fastener element row 35 to the fastener element attaching portion 32 simultaneously with the knitting of the fastener tape 31. A tricot stitch 43 having a knitting pattern of 1-1/1-2/1-1/1-0 as indicated by dash-and-dot lines in FIG. 10 may be added between the two binding chain stitches 40, thus preventing the binding chain stitches 40 from being displaced sideways and hence preventing the coupled fastener element rows 35 from any accidental split while the slide fastener is in use.

The ground structure of the fastener element attaching portion 32 includes along the outermost edge one wale 33 formed of knit loops of a chain stitch 45 having a knitting pattern of 1-0/0-0/0-1/1-1 same as the fastener tape 31. The outermost laid-in weft yarn 47 runs across four wales 33 of the fastener tape 31 in a pattern of 0-0/2-2/4-4/2-2 and its turning ends are interlaced with the chain stitches 45 of the outermost wale 33 at every other courses 34. A reinforcing laid-in weft yarn 48 is laid in the fastener element attaching portion 32, extending across four wales 33 in a zigzag pattern of 4-4/2-2/0-0/2-2 and interlaced with the interlace-free chain stitches of the outermost wale 33 at every other courses 34 alternately with respect to the laid-in weft yarn 47. This reinforcing laid-in weft yarn 48 serves to prevent the outermost edge of the fastener tape 31 from becoming wavy which might happen to occur due to the alternately coarse and dense parts of the knit structure made by the laid-in weft yarn 47 interlaced in every other courses. And the ground structure of the fastener element attaching portion 32 is made dense uniformly throughout the entire length of the fastener tape 31 so that the fastener element row 35 can be attached to the fastener element attaching portion 32 firmly with dimensional stability. Alternatively, the reinforcing laid-in weft yarn 48 to be laid in the fastener element attaching portion 32 may extend across three wales 33 in a zigzag pattern. In another alternative form, likewise the first embodiment, another reinforcing laid-in weft yarn may be added which runs in the same courses as the first-named reinforcing laid-in weft yarn 48, and turns at the wale one wale inwardly of the outermost wale.

In FIG. 10, reference characters B, F represent back needles and front needles, respectively, for alternate courses. The front needles F form stitches of knitting yarns on the upper side of the fastener element row 35. Specifically, a preceding needle loop 42 of each of the two binding chain stitches 40 on one side of a double chain stitch structure is formed over the fastener element row 35 and is interlooped with a succeeding needle loop 42 of the same binding chain stitch 40 on the same side of the double chain stitch structure, thus forming a succession of chain stitches longitudinally over the fastener element row 35. When a tricot stitch 43 is used for binding, its stitches are knit by the front needles F together with the stitches of the binding chain stitches 40. Meanwhile the back needles B knit ground structure of the fastener element attaching portion 32 and the remaining part of the fastener tape 31; the fastener tape 31 is knitted of the chain stitches 44, the tricot stitches 46 and the laid-in weft yarns 47, while the other side of the double knit structure where the fastener element row 35 is supported is formed of needle loops 41, which are located under the fastener element row 35, of the binding chain stitch 40, needle loops of the tricot stitch 46 consisting the ground structure of the fastener tape, the laid-in weft yarns 47 extending from the fastener tape side, and reinforcing laid-in weft yarn 48 laid in the fastener element attaching portion 32 in a zigzag pattern, so that a closely knit thick structure can be realized.

FIG. 13 is a fragmentary transverse cross-sectional view showing the posture in which opposed fastener element rows 35 are attached to the respective fastener element attaching portions of the fastener tapes 31. The outermost edge 52 of each fastener tape 31 is free from becoming wavy, because two kinds of laid-in weft yarns alternately turn at every course and are interlaced with knit loops of an outermost chain stitch 45, without any knitting yarn fraying locally from the outermost edge 52, so that a slider 20 can be moved smoothly without the frayed knitting yarn contacting in a guide channel 21.

As is apparent from the foregoing description, in the fastener element attaching portion of the warp-knit fastener tape, the outermost edge is kept free from becoming wavy by alternately arranging the laid-in weft yarn extending from the fastener tape and the reinforcing laid-in weft yarn in the ground structure where the continuous fastener element row is supported. The resulting ground structure of the fastener element attaching portion is uniformly dense so that the fastener element row can be secured to the fastener element attaching portion firmly with dimensional stability. The number of wales across which the reinforcing laid-in weft yarn extends may be selected from, for example, three or four, depending on the size of the fastener element row. And an additional laid-in weft yarn of the same pattern may be used in parallel.

The number of the knitting yarns for binding the continuous fastener element row may be two or three depending on the size of the fastener element row. Further, the binding yarns may be more highly heat-shrinkable and larger in size than the knitting yarns of the ground structure of the fastener tape so that the binding yarns can be tightened firmly as they shrink by heat-setting the slide fastener in the final finishing process, thus attaching the fastener element row to the fastener element attaching portion firmly. When the chain stitch at the outermost edge of the fastener element attaching portion and the chain stitch, which is adjacent to the fastener element attaching portion, of the fastener tape are larger in size than the remaining chain stitches of the ground structure of the fastener tape, it is possible to keep the shape of the fastener element attaching portion and to reinforce the knit structure of the fastener element attaching portion.

In the foregoing embodiments, the continuous fastener element row is a coiled type. Alternatively, the fastener element row may be a zigzag type, in which the monofilament has a succession of horizontal U shape arranged longitudinally and adapted to be located alternately on the upper and lower sides of the fastener tape. Further, the continuous fastener element row may be knitted in one surface of the fastener element stacking portion in such a manner that the coupling heads and the connecting portions are placed oppositely to the above embodiments, and the resulting fastener element attaching portion is folded so that the coupling heads can be coupled as a concealed slide fastener.

In the foregoing embodiments, the ground structure of the fastener tape is composed of chain stitches, tricot stitches and laid-in weft yarns. Alternatively, two-needle stitches may substitute for the tricot stitches, and the binding chain stitches may have either closed or open loops.

According to this invention, with one arrangement in which a plurality of laid-in weft yarns are laid in the ground structure of the fastener element attaching portion so as to turn alternately at every courses and to be interlaced with the chain stitches extending along the outermost edge of the fastener element attaching portion, it is possible to make the ground structure close and thick so that the fastener element row can be attached firmly with dimensional stability. With the same arrangement, it is possible to give the knit slide fastener an adequate degree of resistance against bending of thrusting the fastener surface upwardly, thus preventing the coupled fastener element rows from any accidental split while the slide fastener is in use. The outermost edge of the fastener tape is kept free from becoming wavy due to the alternately coarse and dense parts of the ground structure of the fastener element attaching portion, without any knitting yarn fraying locally from the outermost edge, so that a slider can be moved smoothly without the frayed knitting yarn contacting in a guide channel.

With another arrangement in which the fastener element row is secured to the fastener element attaching portion by a plurality of binding chain stitches knitted in a double structure, it is possible to guarantee the same advantageous results as with the single knit structure knitted of a plurality of binding chain stitches.

What is claimed is:

1. A knit slide fastener comprising:

(a) a pair of fastener tapes each composed of a warp-knit ground structure having a fastener element attaching portion at a longitudinal edge portion thereof;

(b) a pair of continuous fastener element rows each knitted in one of said fastener element attaching portions simultaneously with the knitting of the respective fastener tape;

(c) a plurality of binding chain stitches knitted in each said fastener element attaching portion to bind each said fastener element row to a ground structure of each said fastener element attaching portion;

(d) a plurality of laid-in weft yarns laid in said fastener element attaching portion; and (d) an edge chain stitch having a succession of knit loops extending along an outermost edge of each said fastener element attaching portion, every one of said knit loops being interlaced with one of said laid-in weft yarns, and excluding said fastener elements to form the ground structure of said fastener element attaching portion.

2. A knit slide fastener comprising:

(a) a pair of fastener tapes each composed of a warp-knit ground structure having a fastener element attaching portion at a longitudinal edge portion thereof;

(b) a pair of continuous fastener element rows each knitted in one of said fastener element attaching portions simultaneously with the knitting of the respective fastener tape;

(c) a plurality of binding chain stitches knitted in a double knit structure in each said fastener element attaching portion to bind said fastener element row to a ground structure of each said fastener element attaching portion;

(d) a plurality of laid-in weft yarns laid in said fastener element attaching portion; and (e) an edge chain stitch having a succession of knit loops extending along an outermost edge of each said fastener element attaching portion, every one of said knit loops being interlaced with one of said laid-in weft yarns, and excluding said fastener elements to form the ground structure of said fastener element attaching portion.

* * * * *